US008147059B2

(12) United States Patent
Miyata

(10) Patent No.: US 8,147,059 B2
(45) Date of Patent: Apr. 3, 2012

(54) IMAGE FORMING APPARATUS

(75) Inventor: Tsuyoshi Miyata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 424 days.

(21) Appl. No.: 12/505,772

(22) Filed: Jul. 20, 2009

(65) Prior Publication Data

US 2010/0026772 A1 Feb. 4, 2010

(30) Foreign Application Priority Data

Jul. 29, 2008 (JP) ..... 2008-194324

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS

2007/0176996 A1* 8/2007 Yoshida et al. ..... 347/104

FOREIGN PATENT DOCUMENTS

| | | |
|---|---|---|
| JP | 11-348373 | 12/1999 |
| JP | 2006-218806 | 8/2006 |
| JP | 2006-218807 | 8/2006 |
| JP | 2007-176093 | 7/2007 |

* cited by examiner

*Primary Examiner* — Stephen Meier
*Assistant Examiner* — Tracey McMillion
(74) *Attorney, Agent, or Firm* — Cooper & Dunham LLP

(57) ABSTRACT

An image forming apparatus includes a recording head configured to jet liquid droplets; and a sheet supporting unit configured to support a sheet that is conveyed facing the recording head, in such a manner that a predetermined gap is provided between the sheet and the recording head, the sheet supporting unit including fixed ribs and movable ribs, wherein the movable ribs are movable within a range such that a top edge of each of the movable ribs supporting the sheet does not exceed a top edge of each of the fixed ribs supporting the sheet.

4 Claims, 12 Drawing Sheets

IMAGE FORMING APPARATUS

BACKGROUND OF THE INVENTION

1. Field of the Invention

The present invention relates to an image forming apparatus, and more particularly to an image forming apparatus having a recording head for jetting liquid droplets.

2. Description of the Related Art

There is known a liquid-jet recording type inkjet recording apparatus, which is an example of an image forming apparatus such as a printer, a fax machine, a copier, a plotter, and a multifunction peripheral having these functions. Such an inkjet recording apparatus uses recording heads for jetting ink droplets. Specifically, ink droplets are jetted from the recording heads onto a conveyed sheet (the sheet is not limited to paper; the sheet may be an OHP film, or any other sheet on which ink droplets and other types of liquid may adhere; the sheet may also be referred to as a recording medium, a recording sheet, etc.) in order to form images (recording, printing, etc., may be used as synonyms). There is a serial type image forming apparatus for forming images by jetting liquid droplets while the recording head moves in the main scanning direction, and a line type image forming apparatus for forming images by using a line type head as the recording head to jet liquid droplets while the recording head is not moving.

In the present application, an "image forming apparatus" means an apparatus for jetting liquid droplets onto a medium made of paper, threads, fiber, a silk cloth, leather, metal, plastic, glass, wood, ceramics, etc. Furthermore, "image forming" does not only mean to form images having meanings such as characters and figures onto a medium, but also to form images without any meanings such as a pattern (to simply jet liquid droplets onto a medium). "Ink" does not only mean what is typically referred to as ink, but also means any liquid that can be used for forming images, such as recording liquid, fixing process liquid, and liquid. Examples are DNA samples, resist, and pattern materials.

In such an image forming apparatus including a device that forms images by jetting liquid droplets, the gap between the recording head and the sheet has a significant impact on image quality. Therefore, the height position of the carriage carrying the recording head is typically adjustable (the height can be changed) with respect to the platen member supporting the sheet. Otherwise, the height position of the platen member (or a conveying belt) is adjustable with respect to the carriage. Accordingly, the gap can be adjusted.

However, cockling (corrugation) may occur in a sheet that has become swollen as a result of absorbing the ink printed on the sheet. The width of the gap between the recording head and the sheet may change depending on the thickness of the sheet, and may also change depending on the extent of cockling. The sheet with cockling may rise from the platen member and be rubbed against the recording head. Printing failures may occur due to the change in the gap between the recording head and the sheet. Accordingly, in order to flatten out the sheet, plural fixed ribs with predetermined intervals are integrally formed on the platen member in the sheet width direction (main scanning direction), so that the sheet can be prevented from rising.

Conventionally, patent document 1 discloses a sheet supporting means for supporting a sheet facing a recording head. Specifically, movable ribs are provided under a sheet-type member for pressing down a recording sheet, and the movable ribs are moved after the sheet passes through a conveying roller. The purpose of this configuration is to prevent the image quality from degrading due to differences in the height at the trailing edge of the sheet after the sheet has passed through the nip portion of the conveying roller.

Patent Document 1: Japanese Laid-Open Patent Application No. 2006-218806

In patent document 2, movable ribs are provided under a sheet-type member for pressing down a recording sheet, similar to patent document 1. The positions of the movable ribs are moved in accordance with the sheet size. The purpose of this configuration is to prevent the image quality from degrading, by controlling cockling that occurs due to differences in sheet sizes.

Patent Document 2: Japanese Laid-Open Patent Application No. 2006-218807

Patent document 3 discloses a configuration of providing a supporting part that moves on a platen in the sheet conveying direction, so that the sheet edges are constantly supported. The purpose of this configuration is to maintain the distance between the sheet and the recording head at a constant distance, and to perform frameless recording at high speed.

Patent Document 3: Japanese Laid-Open Patent Application No. 2007-176093

Patent document 4 discloses a configuration of providing a movable gap adjusting member for changing the gap between the sheet and the recording head. The movable gap adjusting member is disposed across and opposite to the recording head and the sheet conveying path. The purpose of this configuration is to adjust the gap without degrading the image quality, by maintaining the distance between the recording head and the sheet at a constant distance, at the upstream side and the downstream side of the sheet conveying direction.

Patent Document 4: Japanese Laid-Open Patent Application No. H11-348373

However, cockling cannot be prevented simply by moving the recording head and the platen member relatively with each other to adjust the gap. One approach is to provide movable ribs on the platen member. However, the gap between the recording head and the sheet needs to be maintained with high precision in order to maintain the positional accuracy of the liquid droplets landing on the sheet. Thus, the precision of the gap between the recording head and the sheet may decline due to the movement of the ribs supporting the sheet.

SUMMARY OF THE INVENTION

The present invention provides an image forming apparatus in which one or more of the above-described disadvantages are eliminated.

A preferred embodiment of the present invention provides an image forming apparatus capable of maintaining the gap between the recording head and the sheet with high precision while preventing the gap precision from declining due to cockling.

According to an aspect of the present invention, there is provided an image forming apparatus including a recording head configured to jet liquid droplets; and a sheet supporting unit configured to support a sheet that is conveyed facing the recording head, in such a manner that a predetermined gap is provided between the sheet and the recording head, the sheet supporting unit including fixed ribs and movable ribs, wherein the movable ribs are movable within a range such that a top edge of each of the movable ribs supporting the sheet does not exceed a top edge of each of the fixed ribs supporting the sheet.

According to one embodiment of the present invention, an image forming apparatus is provided, in which cockling in the sheet can be compensated for by moving down the movable ribs while precisely maintaining the gap between the sheet and the recording head with the use of fixed ribs, thereby preventing the gap precision from declining due to cockling.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
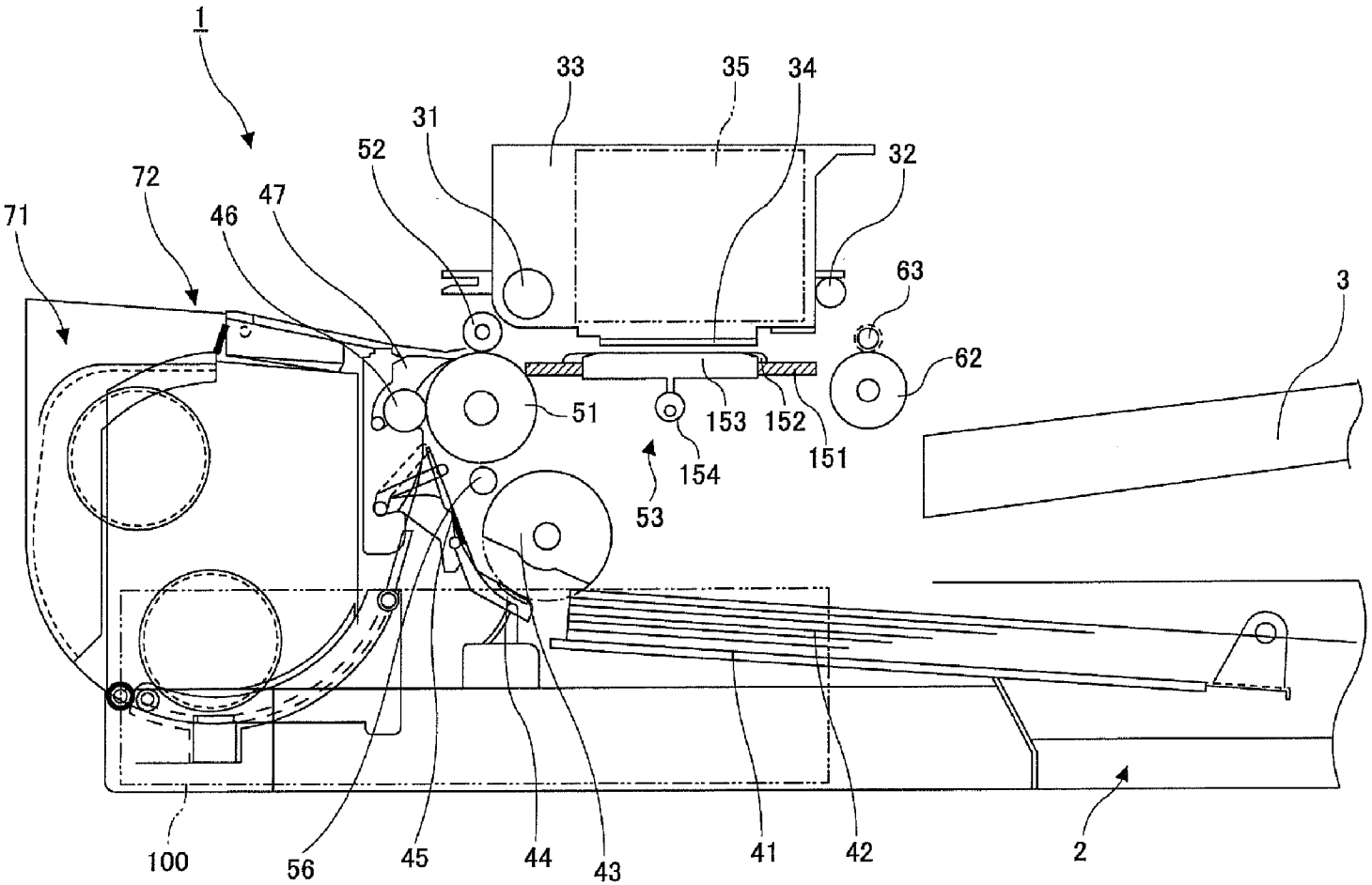
FIG. 1 is a side view of the overall configuration of an image forming apparatus according to an embodiment of the present invention.
Figure 2:
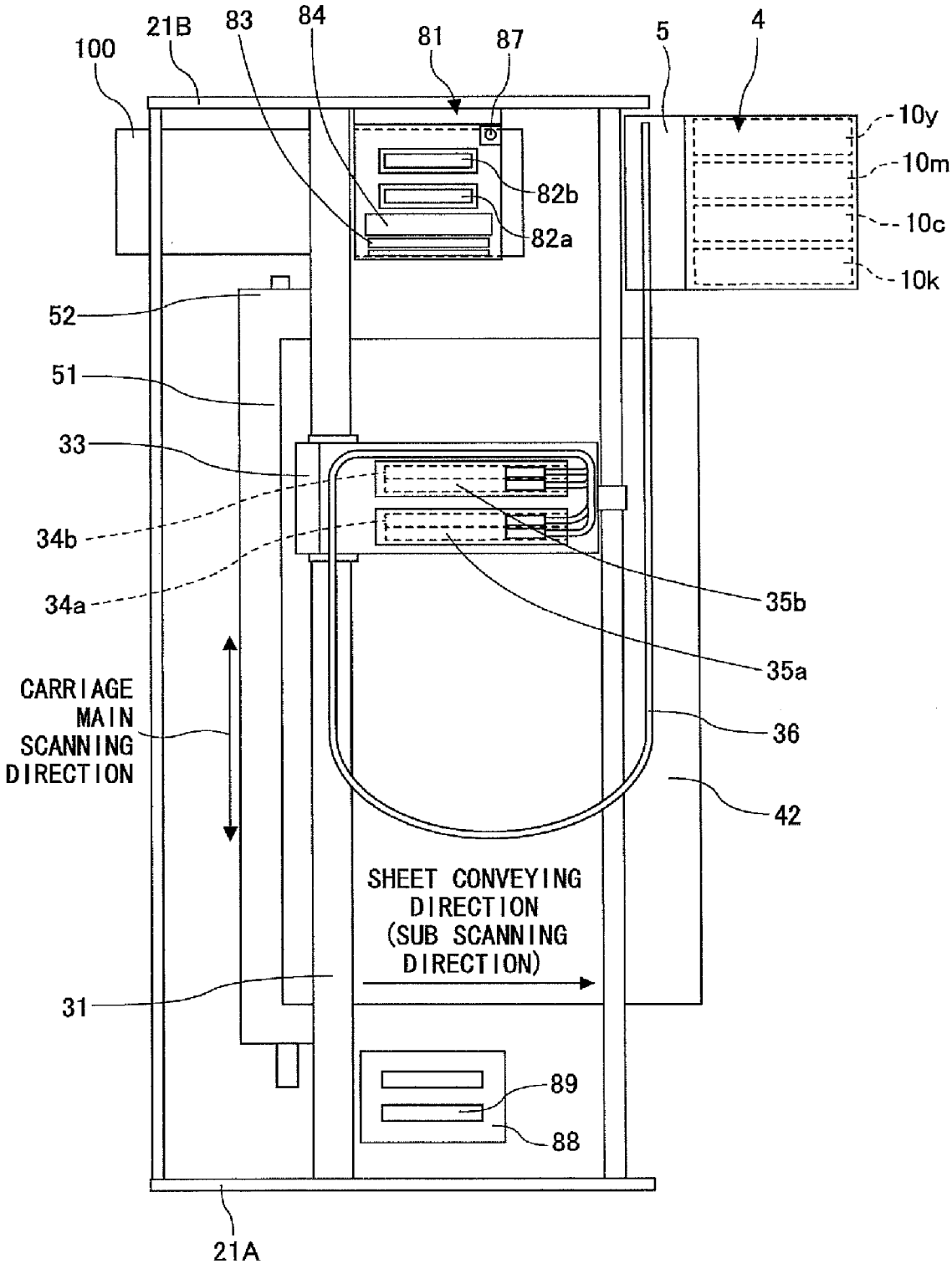
FIG. 2 is a plan view of relevant parts of the image forming apparatus shown in FIG. 1.

A description is given, with reference to the accompanying drawings, of embodiments of the present invention. First, an image forming apparatus according to an embodiment of the present invention is described with reference to FIGS. 1 and 2. FIG. 1 is a side view of the overall configuration of the image forming apparatus, and FIG. 2 is a plan view of relevant parts of the image forming apparatus.

The image forming apparatus is a serial type inkjet recording apparatus. In an apparatus main body 1, a main guide rod 31 and a sub guide rod 32 are guide members that are horizontally provided between left and right side plates 21A and 21B. A carriage 33 is held by the main guide rod 31 and the sub guide rod 32 so as to freely slide in the main scanning direction. A main scanning motor (not shown) scans/moves the carriage 33 in the main scanning direction via a timing belt.

The carriage 33 has recording heads 34*a* and 34*b* (may also be collectively referred to as recording heads 34) including liquid jetting heads for jetting ink droplets of the respective colors of yellow (Y), cyan (C), magenta (M), and black (K). The recording heads 34*a* and 34*b* have nozzle rows including plural nozzles that are disposed in a sub scanning direction orthogonal to the main scanning direction. The nozzles are provided such that the ink is jetted in a downward direction.

Each of the recording heads 34 has two nozzle rows. One of the nozzle rows of the recording head 34*a* is for jetting black (K) liquid droplets, and the other one of the nozzle rows of the recording head 34*a* is for jetting cyan (C) liquid droplets. One of the nozzle rows of the recording head 34*b* is for jetting magenta (M) liquid droplets, and the other one of the nozzle rows of the recording head 34*b* is for jetting yellow (Y) liquid droplets.

The carriage 33 has sub tanks 35*a* and 35*b* (may also be collectively referred to as sub tanks 35) for supplying ink of the respective colors to the corresponding nozzle row of the recording heads 34. Ink of the respective colors is supplied to the sub tanks 35 by a supplying pump unit 5 through supplying tubes 36 of the respective colors, from ink cartridges of the respective colors 10*y*, 10*m*, 10*c*, and 10*k* that are detachably attached to a cartridge loading unit 4.

Meanwhile, a sheet feeding unit is for feeding sheets 42 stacked on a sheet stacking unit (platen) 41 of a sheet feeding tray 2. The sheet feeding unit includes a semilunar roller (sheet feeding roller) 43 for separating the sheets 42 one by one and feeding out the separated sheet 42 from the sheet stacking unit 41, and a separation pad 44 made of a material with a high friction coefficient facing the semilunar roller 43.

In order to send the sheet 42 fed out by the sheet feeding unit to a lower part of the recording head 34, there is provided a guide member 45 for guiding the sheet 42, a counter roller 46, and a conveying guide member 47. Furthermore, there is provided a conveying unit for conveying the sent sheet 42 at a position facing the recording heads 34. The conveying unit includes a conveying roller 51 and a pinch roller 52 facing the conveying roller 51. Moreover, there is provided a sheet supporting unit 53 (described in detail below) having plural fixed ribs and plural movable ribs, whereby the sheet supporting unit 53 supports the sheet 42 sent out by the conveying roller 51 at a position facing the recording heads 34, with a predetermined gap between the sheet 42 and the recording heads 34.

A sheet eject unit is provided for ejecting the sheet 42 on which images have been recorded by the recording heads 34. The sheet eject unit includes a sheet eject roller 62 and a spur 63 which is a sheet eject roller. Furthermore, a sheet eject tray 3 is provided under the sheet eject roller 62.

A double-side unit 71 is detachably attached onto the back side of the apparatus main body 1. The double-side unit 71 takes in the sheet 42 that is returned as the conveying roller 51 rotates in the opposite direction, reverses the sheet 42, and once again supplies the reversed sheet 42 in between the counter roller 46 and the conveying roller 51. The top face of the double-side unit 71 is a manual-sheet-feed tray 72.

In a non-printing region on one side of the scanning direction of the carriage 33, there is provided a maintenance/recovery mechanism 81 for maintaining and recovering the conditions of the nozzles of the recording heads 34. The maintenance/recovery mechanism 81 includes cap members (hereinafter, "caps") 82*a* and 82*b* (may also be collectively referred to as "caps 82") for capping the nozzle surfaces of the recording heads 34, a wiper member (wiper blade) 83 for wiping the recording heads 34, an idle jetting receiver 84 for receiving liquid droplets when idle jetting is performed to jet liquid droplets that are not used for recording but for discharging recording liquid with increased viscosity, and a carriage lock 87 for locking the carriage 33. Under the maintenance/recovery mechanism 81 of the head, a replaceable waste liquid tank 100 is attached to the apparatus main body 1. The waste liquid tank 100 is for accommodating waste liquid that is generated as a result of a maintenance/recovery operation.

In a non-printing region on the other side of the main scanning direction of the carriage 33, an idle jetting receiver 88 is provided for receiving liquid droplets when idle jetting is performed to jet liquid droplets that are not used for recording but for discharging recording liquid with increased viscosity during recording. The idle jetting receiver 88 has openings 89 extending along the nozzle row direction of the recording heads 34.

In an image forming apparatus with such a configuration, the sheets 42 are separated one by one and the separated sheet 42 is fed out from the sheet feeding tray 2. The sheet 42 is supplied in a substantially vertically upward direction, guided by the guide member 45, conveyed by being sandwiched between the conveying roller 51 and the counter roller 46, and pressed against the conveying roller 51 by the pinch roller 52. Then, the conveying direction of the sheet 42 is changed by substantially 90°, and sent out to a position where images are formed by the recording heads 34.

By driving the recording heads 34 in accordance with image signals while moving the carriage 33, ink droplets are jetted onto the still sheet 42 to record one line. Then, the sheet 42 is conveyed by a predetermined amount, to record the next row. Upon receiving a record end signal or a signal indicating that the trailing edge of the sheet 42 has reached the recording region, the recording heads 34 end the recording operation, and the sheet 42 is ejected to the sheet eject tray 3.

Figure 3:
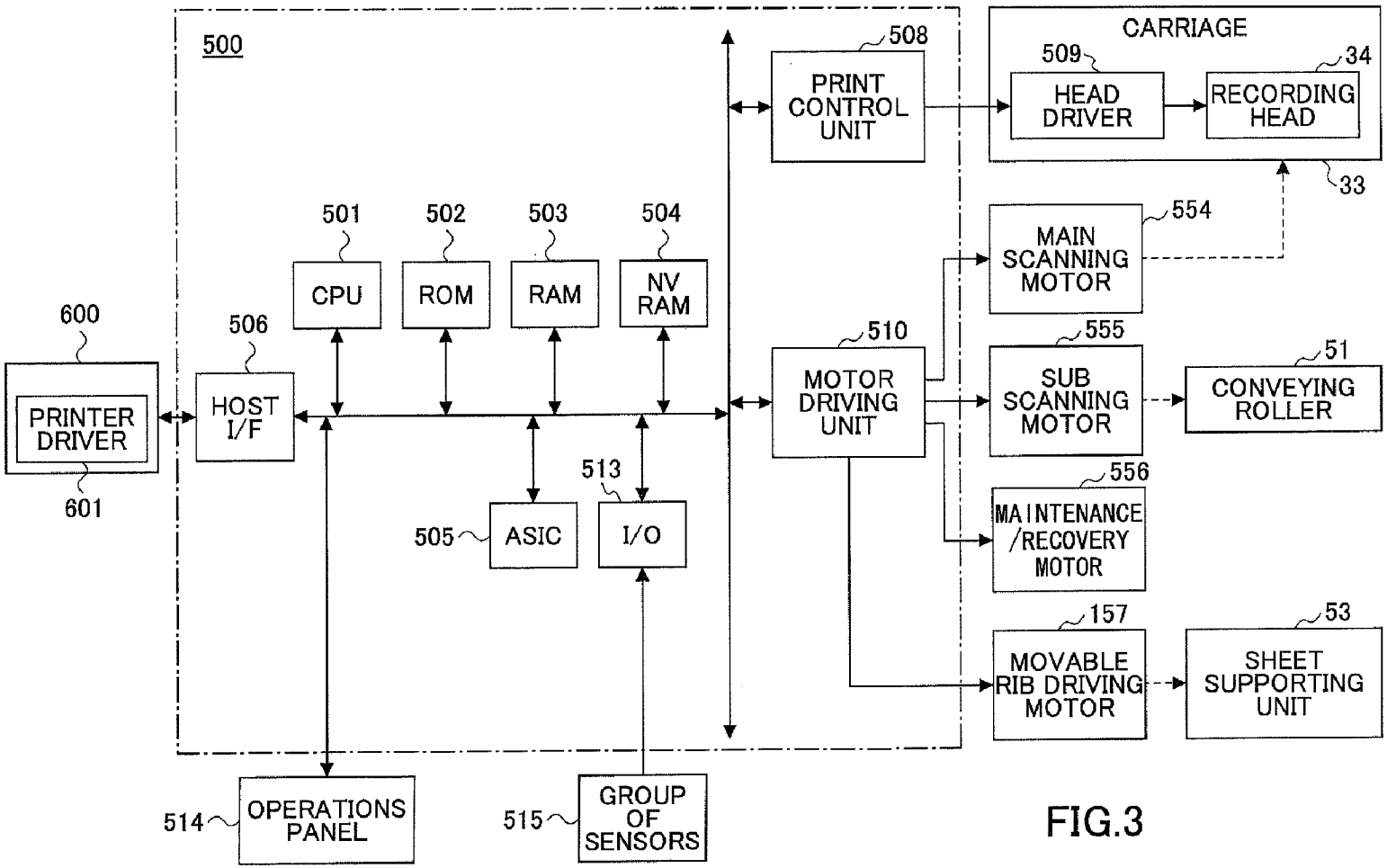
FIG. 3 is an overall block diagram of a control unit of the image forming apparatus shown in FIG. 1.

Next, a brief description is given of a control unit of the image forming apparatus with reference to FIG. 3. FIG. 3 is an overall block diagram of the control unit.

A control unit 500 includes a CPU 501 for controlling the entire apparatus and also for controlling the movable ribs according to an embodiment of the present invention; a ROM 502 for storing programs executed by the CPU 501 and other fixed data; a RAM 503 for temporarily storing image data, etc.; a rewritable non-volatile memory 504 for storing data even while the power of the apparatus is turned off; and an ASIC 505 for performing various signal processing on the image data, image processing such as sorting, and input output signal processing to control the entire apparatus.

Furthermore, the control unit 500 includes a print control unit 508 having a data transfer unit and a driving signal generating unit for driving/controlling the recording heads 34; a head driver (driver IC) 509 for driving the recording heads 34 provided on the carriage 33; a main scanning motor 554 for moving/scanning the carriage 33; a sub scanning motor 555 for rotating the conveying roller 51; a maintenance/recovery motor 556 of the maintenance/recovery mechanism 81; and a motor driving unit 510 for driving a movable rib driving motor 157 that raises/lowers the movable ribs of the sheet supporting unit 53.

The control unit 500 also has an operations panel 514 connected thereto for inputting information necessary for the apparatus and displaying the information.

The control unit 500 has an I/F 506 for exchanging data and signals between the host side. Specifically, the control unit 500 receives, via a cable or a network, such data from a host 600 side such as an image processing apparatus such as a personal computer, an image scanning device such as an image scanner, and an image pickup device such as a digital camera.

The CPU 501 of the control unit 500 reads and analyzes the print data in the receiving buffer included in the I/F 506, performs the necessary image processing and data sorting processing at the ASIC 505, and transfers the image data from the print control unit 508 to the head driver 509. Dot pattern data for outputting the image is generated at a printer driver 601 on the host 600 side.

The print control unit 508 transfers, to the head driver 509, the image data as serial data, and a transfer clock, a latch signal, and a control signal necessary for transferring the data and confirming the transfer. Furthermore, the print control unit 508 includes a driving signal generating unit including a D/A converter for performing D/A conversion on pattern data of driving pulses stored in the ROM, a voltage amplifier, and a current amplifier, and outputs driving signals of one driving pulse or plural driving pulses to the head driver 509.

The head driver 509 drives the recording heads 34 by selectively applying driving pulses to a driving element (for example, a piezoelectric element) that generates energy for jetting liquid droplets from the recording heads 34. The driving pulses constitute driving signals that are received from the print control unit 508, based on image data input in a serial manner corresponding to one line of the recording heads 34. By selecting the driving pulse constituting the driving signals, it is possible to form dots of different sizes by jetting large liquid droplets, middle-sized liquid droplets, and small liquid droplets.

An I/O unit 513 acquires information from a group of various sensors 515 provided in the apparatus, extracts information necessary for controlling the printer, and uses the extracted information for driving/controlling the units for driving the print control unit 508 and the motor driving unit 510. The group of sensors 515 includes an optical sensor for detecting the type and thickness of the sheet, a thermistor for monitoring the temperature and humidity inside the apparatus, and an interlock switch for detecting whether the cover is open/closed. The I/O unit 513 can process various types of sensor information.

Figure 4:
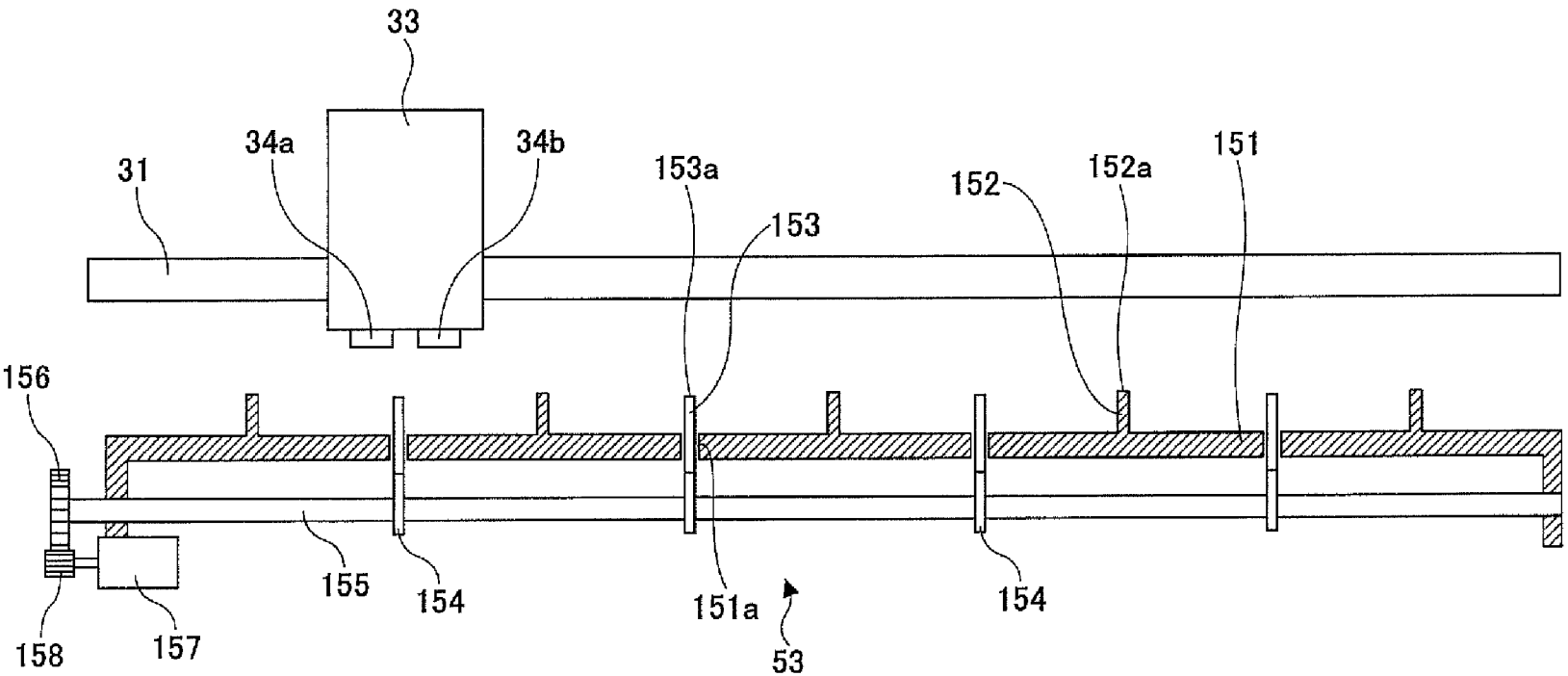
FIG. 4 is a front view of a sheet supporting unit for describing a configuration of the sheet supporting unit.
Figure 5:
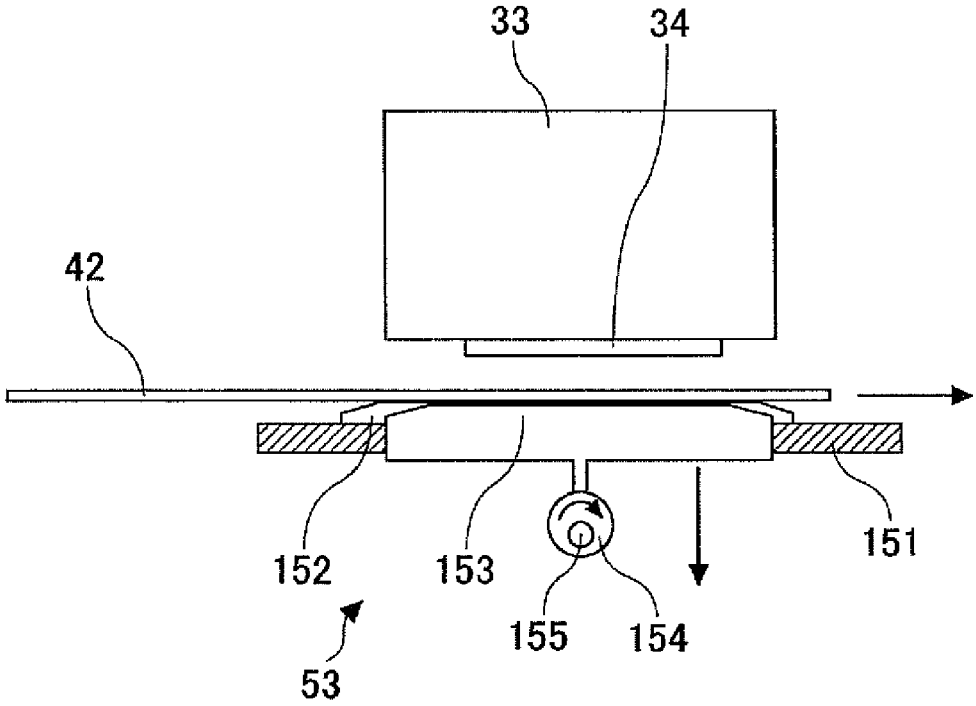
FIG. 5 is a side view of the sheet supporting unit for describing the configuration of the sheet supporting unit.

Next, a description is given of the sheet supporting unit 53 of the image forming apparatus with reference to FIGS. 4 and 5. FIG. 4 is a front view and FIG. 5 is a side view.

The sheet supporting unit 53 has a platen member 151 disposed along a main scanning direction of the carriage 33. Plural fixed ribs 152 are integrally formed on the platen member 151. The ribs 152 support the conveyed sheet 42 facing the recording heads 34, with a predetermined gap between the sheet 42 and the nozzle surfaces of the recording heads 34. Furthermore, movable ribs 153 capable of moving up and down are provided in slits (openings) 151*a*, each of the slits 151*a* being formed between two fixed ribs 152.

The lower edge of each of the movable ribs 153 is held in contact with the top part of a cam 154. The cams 154 are fixed to a cam shaft 155. On one end of the cam shaft 155, there is provided a gear 156. A motor gear 158 of a movable rib driving motor 157 engages the gear 156. Accordingly, as the movable rib driving motor 157 rotates, the cams 154 are rotated by the cam shaft 155, so that the movable ribs 153 move up and down.

The movable ribs 153 are movable within a range such that a top edge 153*a* of each movable rib 153 supporting the sheet 42 does not exceed a top edge 152*a* of each fixed rib 152 supporting the sheet 42. That is, when each movable rib 153 is moved up to the maximum height, the position of the top edge 153*a* is equal to the position of the top edge 152*a* of each fixed rib 152. This position is set as the initial position, and the movable ribs 153 are moved down starting from the initial position.

Figure 6:
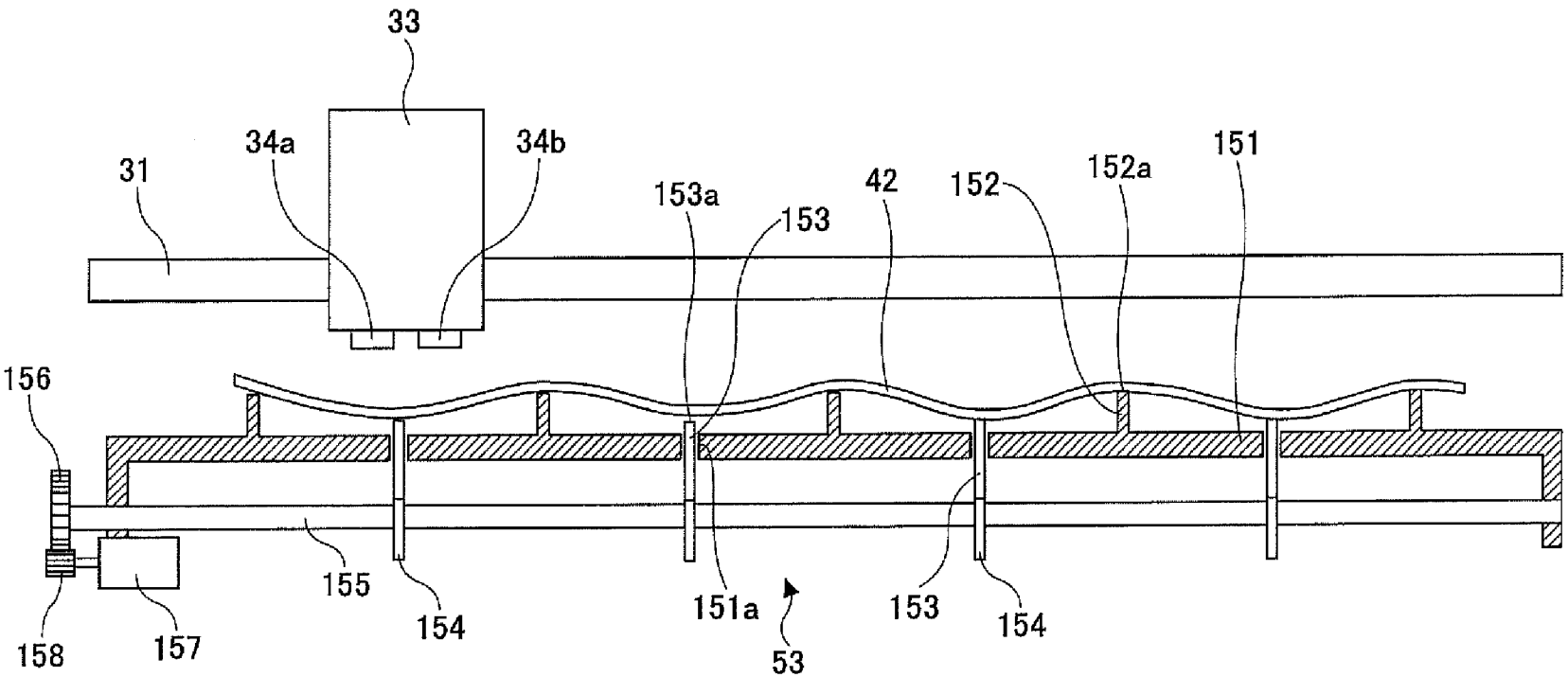
FIG. 6 is a front view of the sheet supporting unit for describing an operation of the sheet supporting unit.
Figure 7:
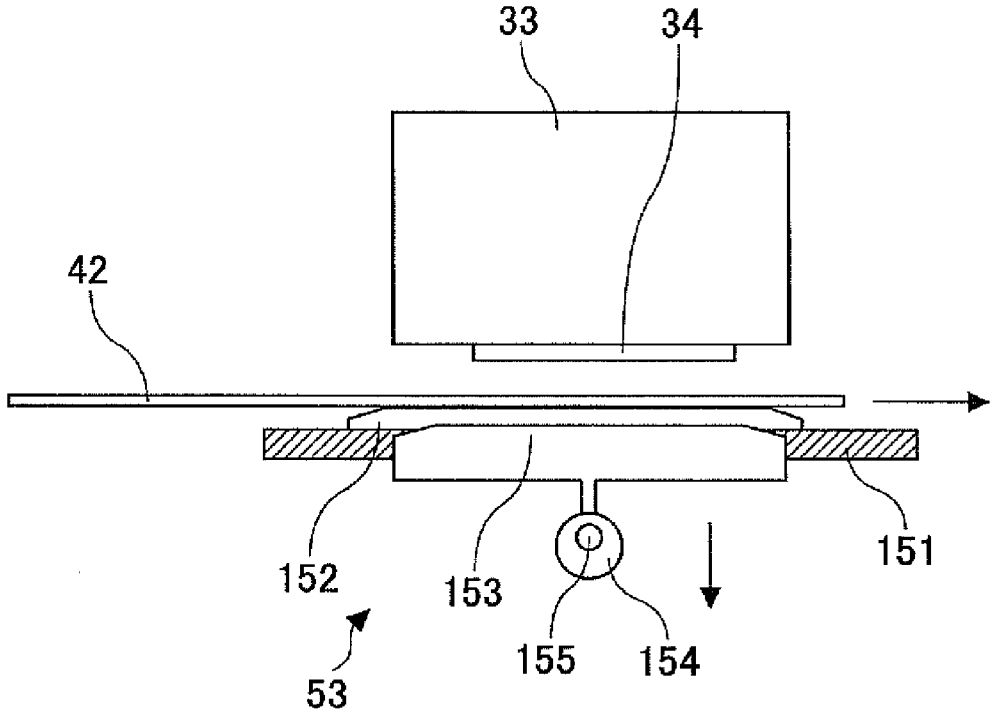
FIG. 7 is a side view of the sheet supporting unit for describing the operation of the sheet supporting unit.

According to such a configuration, as shown in FIGS. 6 and 7, when an image is formed on the sheet 42 with the recording heads 34, the movable rib driving motor 157 is driven to rotate the cams 154, so that the movable ribs 153 are moved down. Thus, as shown in FIG. 6, even when cockling (corrugation) occurs in the sheet 42 as a result of forming an image by jetting liquid droplets onto the sheet 42 with the recording heads 34, the movable ribs 153 between the fixed ribs 152 are moved down, and therefore the cockling can be compensated for. At this time, the gap between the sheet 42 and the recording heads 34 is maintained by the fixed ribs 152, thereby maintaining the gap with high precision.

As described above, a sheet supporting unit has plural fixed ribs and plural movable ribs, and supports a conveyed sheet facing the recording heads with a predetermined gap between the sheet and the recording heads. The height of the movement range of the movable ribs is set such that a top edge of each movable rib supporting the sheet does not exceed a top edge of each fixed rib supporting the sheet. Accordingly, the movable ribs can be moved down to compensate for cockling while the fixed ribs are maintaining the gap with high precision, thereby preventing the precision of the gap from declining due to cockling.

Figure 8A:
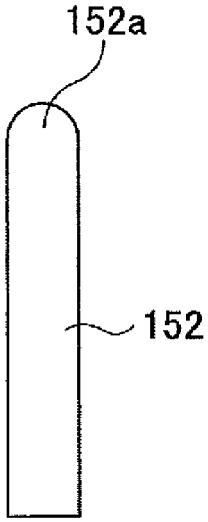
FIGS. 8A and 8B are enlarged views of examples of different shapes of the top edge of a rib.
Figure 8B:
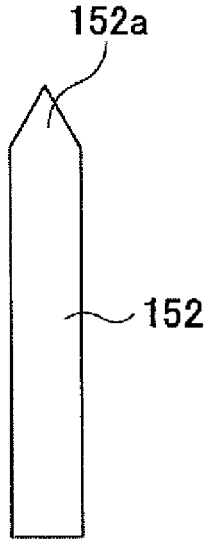

Next, a description is given of examples where the top edges of the fixed ribs (and movable ribs) have different shapes, with reference to FIGS. 8A and 8B. In the example shown in FIG. 8A, the top edge 152*a* of the fixed rib 152 has a cross-sectional shape that is semicircular or semiellipse. In the example shown in FIG. 8B, the top edge 152*a* of the fixed rib 152 has a cross-sectional shape that becomes smaller toward the tip, thereby forming an pointed shape. According to these examples, the contact area between the sheet 42 and the ribs 152 and 153 is reduced, so that friction is decreased and the sheet can be conveyed with high precision.

A material having high sliding properties may be used to form each fixed rib 152 and each movable rib 153, at least at the tip part that contacts the sheet. Accordingly, friction can be further decreased and the sheet can be conveyed with higher precision.

Figure 9A:
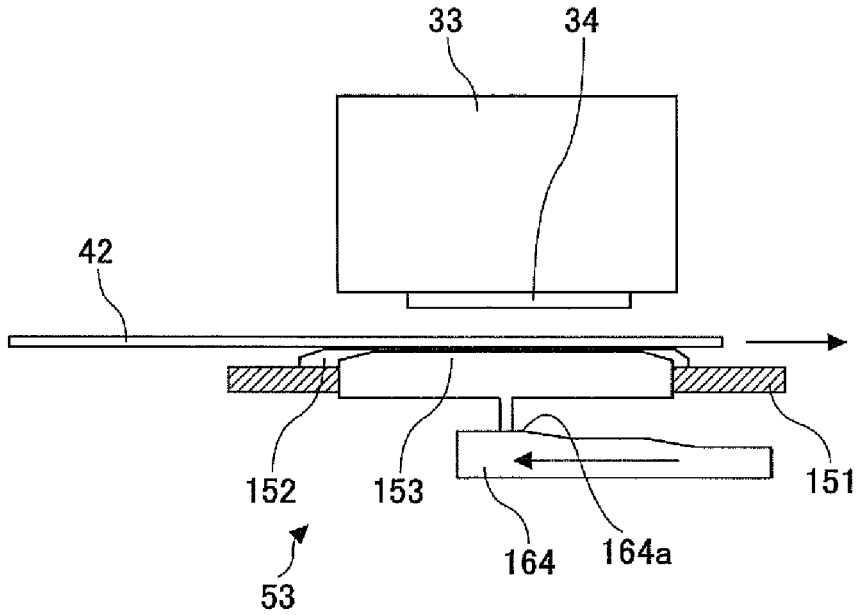
FIGS. 9A and 9B are side views of examples of other up and down mechanisms of the movable ribs.
Figure 9B:
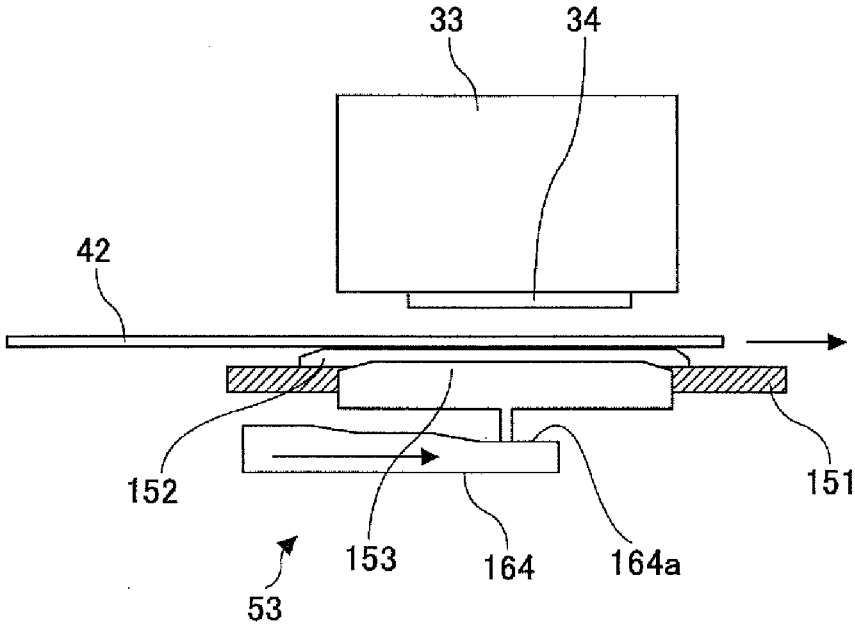

Next, a description is given of another example of an up and down mechanism of the movable ribs 153, with reference to FIGS. 9A and 9B.

The bottom edge of each movable rib 153 is in contact with a cam surface 164*a* having three stages (may be two stages or four or more stages). The cam surface 164*a* is formed on a sliding cam 164 that moves the movable ribs 153 up and down by moving back and forth in the direction indicated by the arrow. FIG. 9A indicates the state of the initial position, where the heights of the movable ribs 153 are equal to those of the fixed ribs 152. FIG. 9B indicates the state of the movable ribs 153 being moved down from the initial position.

Figure 10:
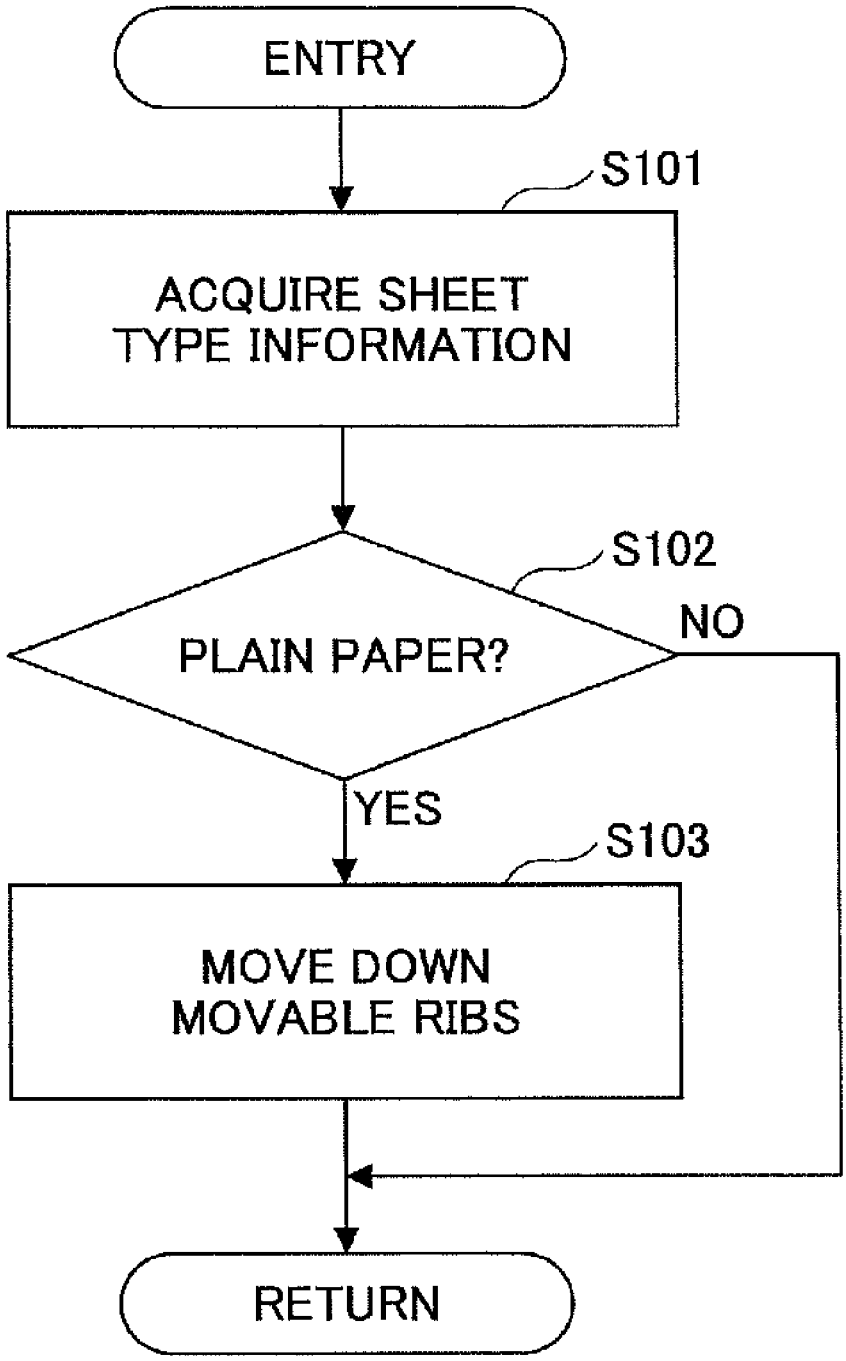
FIG. 10 is a flowchart of an example of a control operation performed by the control unit for moving the movable ribs up and down.

Next, an example of a control operation performed by the control unit 500 for moving up and down the movable ribs 153 is described with reference to the flowchart shown in FIG. 10.

In this example, the positions of the movable ribs 153 are changed depending on whether the sheet type is plain paper or another sheet type (cardboard such as a post card or an envelope, or an OHP film). Specifically, the control unit 500 acquires sheet type information provided from the printer driver 601 of the host 600, or sheet type information provided from the operations panel 514 (step S101). When the sheet type is plain paper (YES in step S102), the control unit 500 rotates the movable rib driving motor 157 to move down the movable ribs 153 (step S103). When the sheet type is a material other than plain paper (NO in step S102), the control unit 500 leaves the movable ribs 153 at the initial position (same height position as the fixed ribs 152).

When the sheet used for printing is a cardboard sheet or an OHP film, cockling is unlikely to occur as a result of liquid droplets adhering to the sheet, and therefore the movable ribs are left at the initial position. When the sheet used for printing is plain paper, in order to prevent the precision of the gap from declining due to cockling, the movable ribs are moved down to compensate for the cockling.

Figure 11:
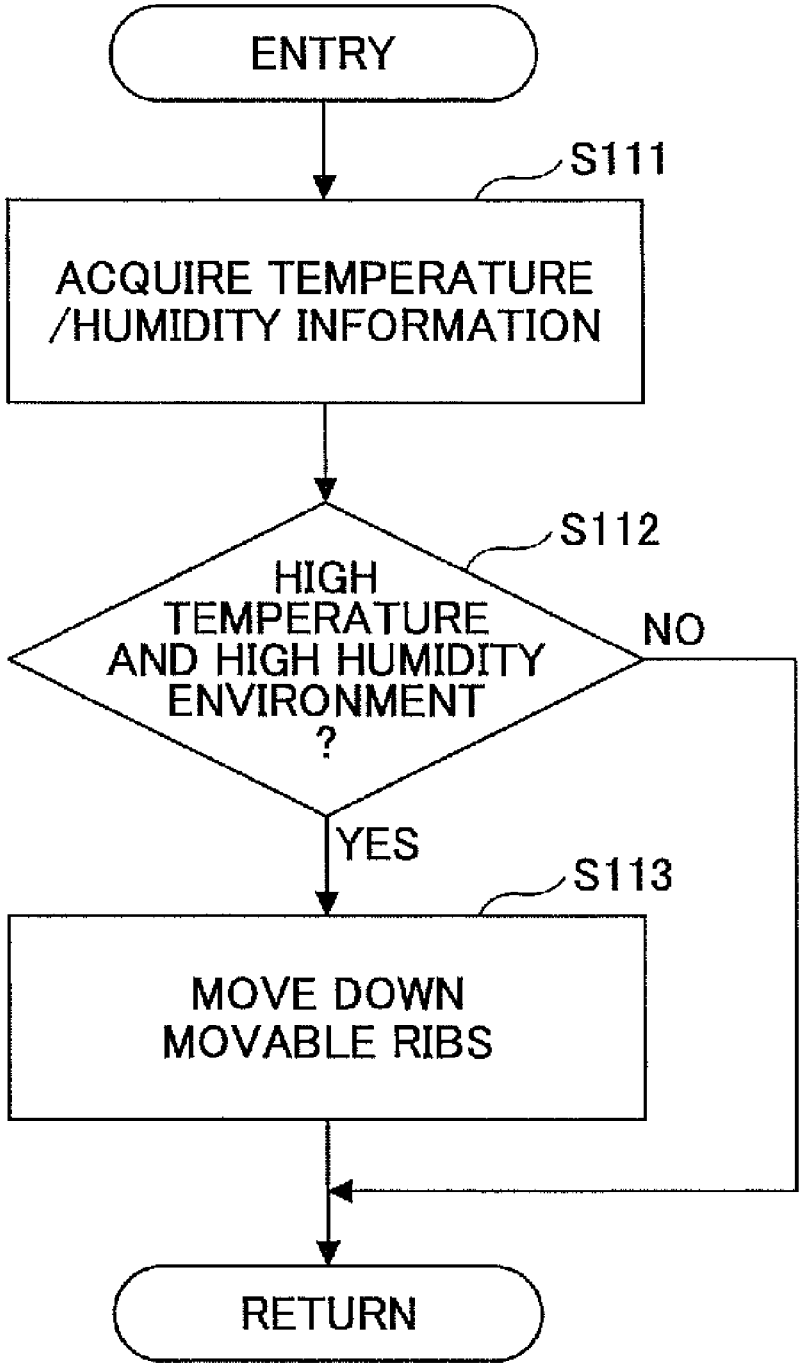
FIG. 11 is a flowchart of another example of the control operation performed by the control unit for moving the movable ribs up and down.

Next, another example of a control operation performed by the control unit 500 for moving up and down the movable ribs 153 is described with reference to the flowchart shown in FIG. 11.

In this example, the positions of the movable ribs 153 are varied in accordance with the environmental temperature and the environmental humidity. The control unit 500 acquires the temperature/humidity information provided from the printer driver 601 of the host side 600, or the temperature/humidity information provided from an environment sensor and input to the I/O unit 513 (step S111). The control unit 500 determines whether the environmental temperature is greater than or equal to a temperature defined in advance, and whether the environmental humidity is greater than or equal to a humidity defined in advance (high temperature and high humidity environment) (step S112). When the environment is a high temperature and high humidity environment (YES in step S112), the control unit 500 rotates the movable rib driving motor 157 to move down the movable ribs 153 (step S113). When the environment is not a high temperature and high humidity environment (NO in step S112), the control unit 500 leaves the movable ribs 153 at the initial position (same height position as the fixed ribs 152).

Figure 12:
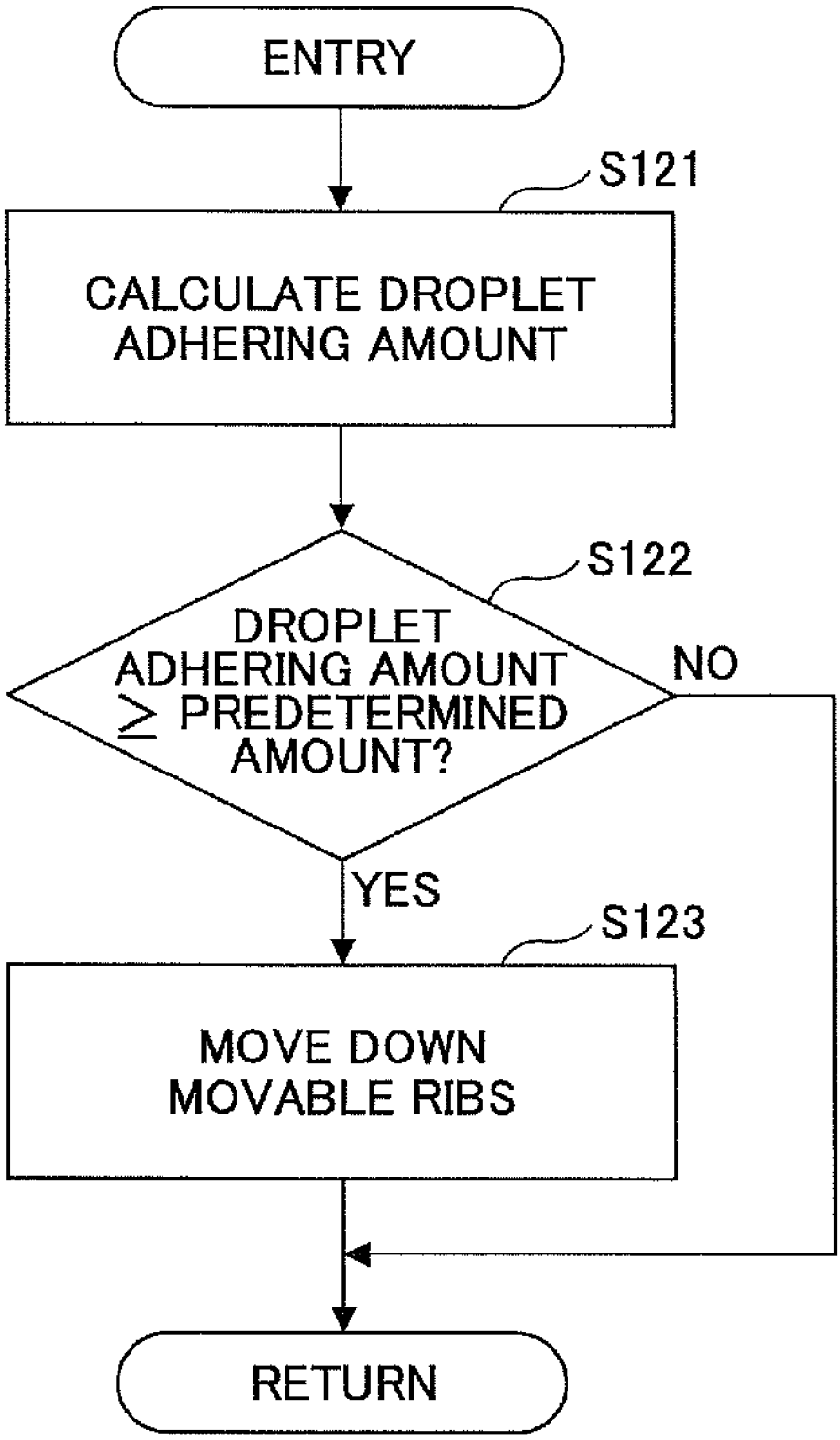
FIG. 12 is a flowchart of another example of the control operation performed by the control unit for moving the movable ribs up and down.

Next, yet another example of a control operation performed by the control unit 500 for moving up and down the movable ribs 153 is described with reference to the flowchart shown in FIG. 12.

In this example, the control unit 500 calculates the adhering amount of a liquid droplet that has landed on a sheet to print an image (droplet adhering amount) (step S121), and determines whether the droplet adhering amount is greater than or equal to a predetermined amount that has been defined in advance (step S122). When the droplet adhering amount is greater than or equal to the predetermined amount (YES in step S122), the control unit 500 rotates the movable rib driving motor 157 to move down the movable ribs 153 (step S123). When the droplet adhering amount is less than the predetermined amount (NO in step S122), the control unit 500 leaves the movable ribs 153 at the initial position (same height position as the fixed ribs 152).

In the above examples, the movable ribs are moved between two stages, i.e., the initial position and the position moved down from the initial position. However, as described in the above embodiment, the movable ribs may be moved among more than two stages, and the position of the movable ribs may be controlled in accordance with the sheet type, the environmental temperature, the environmental humidity, and the droplet adhering amount. Furthermore, the position of the movable ribs may be controlled in accordance with the thickness of the sheet or the droplet adhering ratio (the droplet adhering ratio is obtained by the area of the liquid droplet adhering region with respect to the sheet area).

The image forming apparatus according to an embodiment of the present invention is not limited to a single-functional printer; the image forming apparatus may be a multifunction peripheral having functions of a printer, a fax machine, and a copier.

The present invention is not limited to the specifically disclosed embodiment, and variations and modifications may be made without departing from the scope of the present invention.

The present application is based on Japanese Priority Patent Application No. 2008-194324, filed on Jul. 29, 2008, the entire contents of which are hereby incorporated herein by reference.

What is claimed is:

1. An image forming apparatus comprising:

a recording head configured to jet liquid droplets; and a sheet supporting unit configured to support a sheet that is conveyed facing the recording head, in such a manner that a predetermined gap is provided between the sheet and the recording head, the sheet supporting unit comprising fixed ribs and movable ribs, wherein:

the movable ribs are movable within a range such that a top edge of each of the movable ribs supporting the sheet does not exceed a top edge of each of the fixed ribs supporting the sheet.

2. The image forming apparatus according to claim 1, wherein:

the movable ribs are movable in a stepwise manner or in a stepless manner.

3. The image forming apparatus according to claim 1, wherein:

each top edge of either or both of the fixed ribs and the movable ribs has a cross-sectional shape that is semicircular or semiellipse, or has a cross-sectional shape that becomes smaller toward the tip so as to form a pointed shape.

4. The image forming apparatus according to claim 1, wherein:

the movable ribs are moved in accordance with any one of a type of the sheet, a thickness of the sheet, an environmental temperature, environmental humidity, a droplet adhering amount on the sheet, and a droplet adhering ratio on the sheet.

* * * * *